US006367798B1

(12) United States Patent
Lawal

(10) Patent No.: US 6,367,798 B1
(45) Date of Patent: Apr. 9, 2002

(54) WORD GAME

(76) Inventor: Robert A. Lawal, 95 Ambleside Avenue, Etobicoke, Ontario (CA), M8Z 2H9

( * ) Notice: Subject to any disclaimer, the term of this patent is extended or adjusted under 35 U.S.C. 154(b) by 0 days.

(21) Appl. No.: 09/659,839

(22) Filed: Sep. 11, 2000

(51) Int. Cl.[7] ..... A63F 9/04
(52) U.S. Cl. ..... 273/272; 273/284
(58) Field of Search ..... 273/272, 146, 273/299, 284; 434/171, 172

(56) References Cited

U.S. PATENT DOCUMENTS 1,584,316 A 5/1926 Mayhew
3,393,914 A * 7/1968 Hill
4,448,423 A 5/1984 Augusta
4,469,329 A * 9/1984 Guyer
4,601,473 A 7/1986 Dubren et al.
4,934,700 A 6/1990 Turek
4,966,366 A * 10/1990 Mercado-Torres
5,024,440 A * 6/1991 Tidalgo et al.
5,558,328 A 9/1996 Krantz
5,615,886 A * 4/1997 Chalfin et al.
5,921,864 A * 7/1999 Walker et al.

FOREIGN PATENT DOCUMENTS

WO WO 96/23562 8/1996

* cited by examiner

*Primary Examiner*—William M. Pierce
(74) *Attorney, Agent, or Firm*—Ridout & Maybee LLP

(57) ABSTRACT

A word game and method of playing the word game. The word game has a plurality of letter indicator members, each having a letter indicia corresponding to a selected letter or choice of letter, each letter indicia being assigned a predetermined point value for use in calculating an initial score value of a word formed from a random selection of the letter indicia. The game further includes a plurality of score manipulation members, each having a scoring indicia for manipulating the initial score value and determining a final score of the word. The score manipulation members are arrangeable in a random order from one game to the next.

13 Claims, 3 Drawing Sheets

WORD GAME

FIELD OF THE INVENTION

The present invention relates to parlour games and, more particularly, to parlour games involving the formation of words from randomly selected letters of the alphabet.

BACKGROUND OF THE INVENTION

Parlour games which require a player to form a word from a number of randomly selected letters are known. An example of such games is disclosed in U.S. Pat. No. 1,584,316 to Mayhew issued on Sep. 10, 1925. Another example is the popular board game sold in connection with the trade-mark SCRABBLE. The number of parlour games of this genre attests to the continuing popularity of word games. There is therefore an ongoing need to provide a new and inventive word game which the present invention seeks to meet.

SUMMARY OF THE INVENTION

Accordingly, the present invention provides a word game comprising a plurality of letter indicator members, each having a letter indicia corresponding to a selected letter or choice of letter, each letter indicia being assigned a predetermined point value for use in calculating an initial score value of a word formed from a random selection of said letter indicia; and a plurality of score manipulation members, each having a scoring indicia for manipulating the initial score value and determining a final score value of said word, said score manipulation members being arrangeable in a random order from one game to the next.

In accordance with another aspect, the present invention also provides a method of playing a word game comprising the steps of:

(1) initially,
- (a) providing a plurality of letter indicator members, each having a letter indicia corresponding to a selected letter or choice of letter, each letter indicia being assigned a predetermined point value;
- (b) providing a plurality of score manipulation members, each having scoring indicia; and
- (c) arranging said score manipulation members randomly; and (2) on each player's turn,
- (a) randomly selecting a plurality of said letter indicia;
- (b) randomly selecting one of said score manipulation members;
- (c) forming a word from the letter indicia selected; and
- (d) calculating a final score value of the word so formed with reference to the predetermined point values of the letter indicia in the word and the scoring indicia of the score manipulation member selected.

For the sake of clarity, the term "comprising" when used throughout the specification means "including but not necessarily limited to".

BRIEF DESCRIPTION OF THE DRAWINGS

The invention will be better understood with reference to the following description of a preferred embodiment of the game and method of playing the game in which.

DETAILED DESCRIPTION OF THE PREFERRED EMBODIMENT

Figure 1:
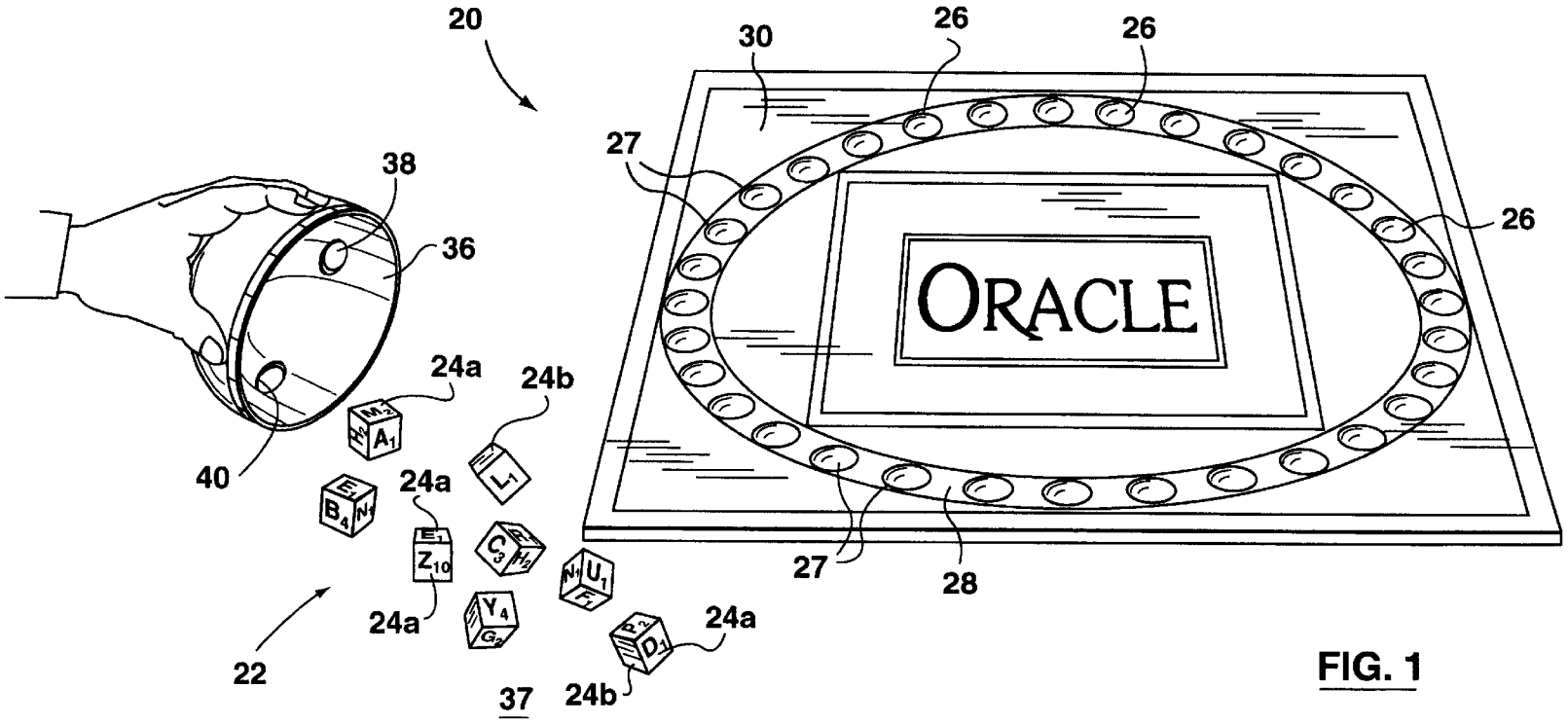
FIG. 1 is a perspective view of a word game according to the preferred embodiment of the invention being used in play.
Figure 3:
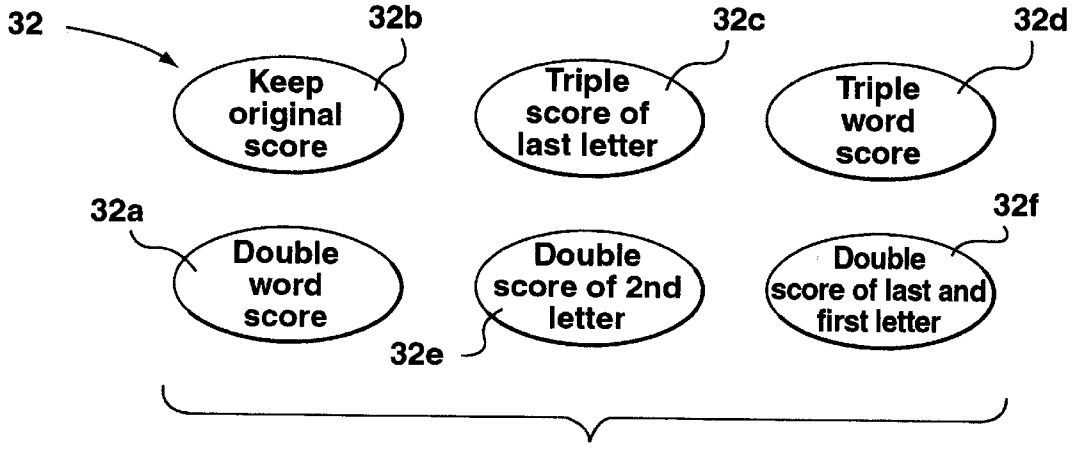
FIG. 3 is a top view of score manipulation members of the game, with the scoring indicia thereof exposed to view.
Figure 5:
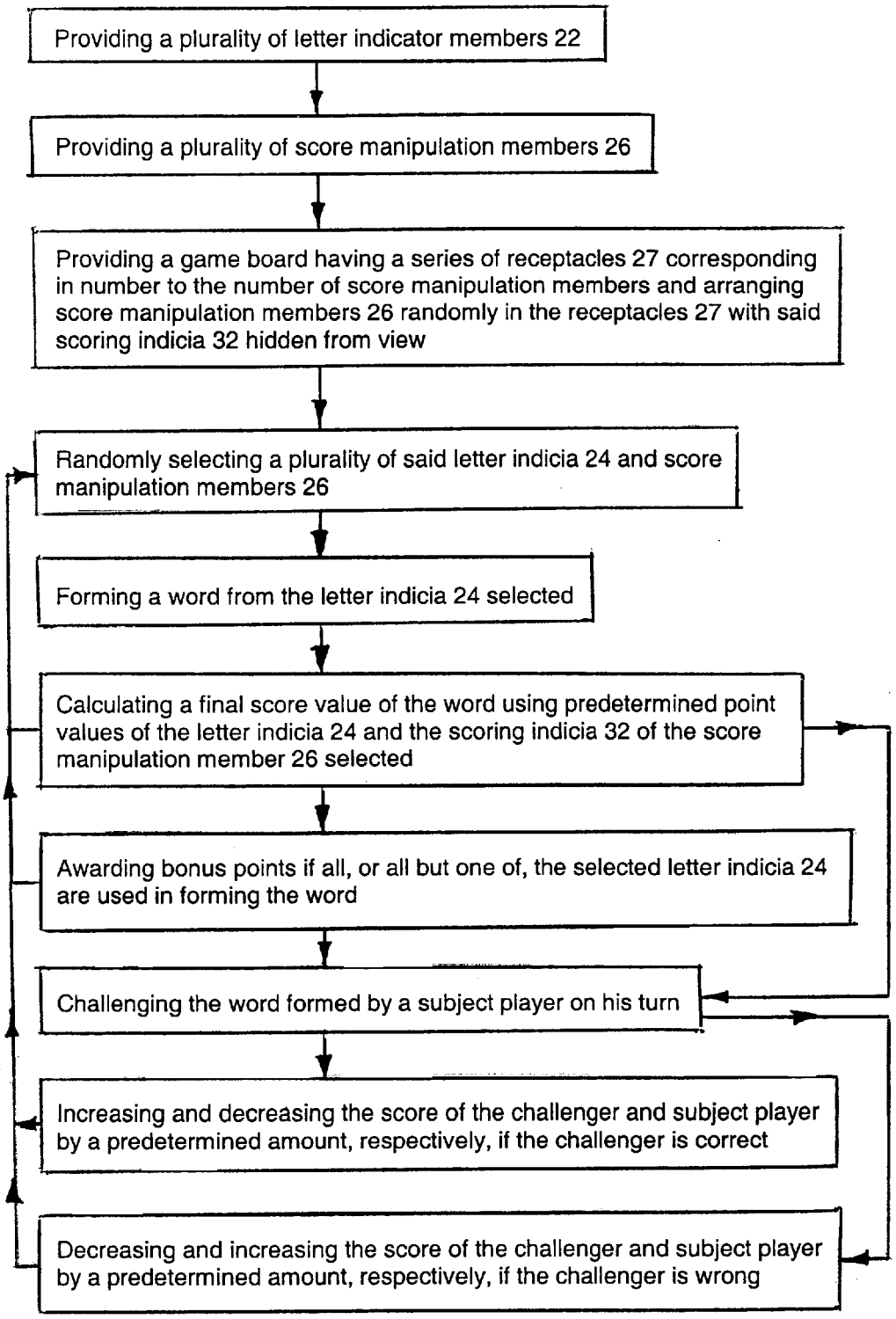
FIG. 5 is a flow chart illustrating the steps used in the preferred method of playing the game.

In FIG. 1, the preferred embodiment of the word game of the invention, designated generally by reference numeral 20, is shown. FIG. 5 illustrates major steps used in playing the game 20. The word game 20 includes a plurality of letter indicator members in the form of eight six-sided dice 22, each having letter indicia 24 marked on the sides thereof. The letter indicia designated generally by numeral 24 is either a selected letter 24*a* of the alphabet or a blank 24*b* which indicates that a choice of letter is provided. Each letter indicia 24 is assigned a predetermined point value. In the case of a blank, the point value is 0. The game 20 also includes a plurality of oval-shaped score manipulation members 26 which, at the start of the game, are arranged in a random order in respective recesses 27 of track 28 of a game board 30. The score manipulation members 26 each have scoring indicia designated generally by reference numeral 32 which, at the beginning of the game, are placed face down in a corresponding recess 27. The scoring indicia 32 is shown in FIG. 3 and will be described below.

Figure 2:
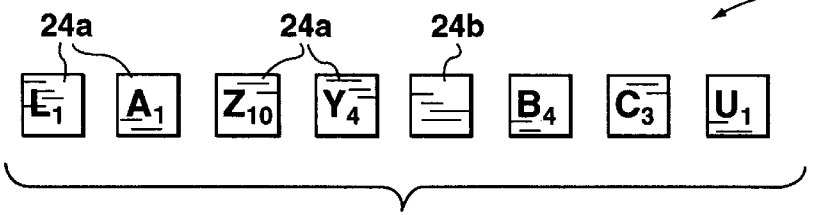
FIG. 2 is a top view of selected letter indicia of letter indicator members of the game.
Figure 4:
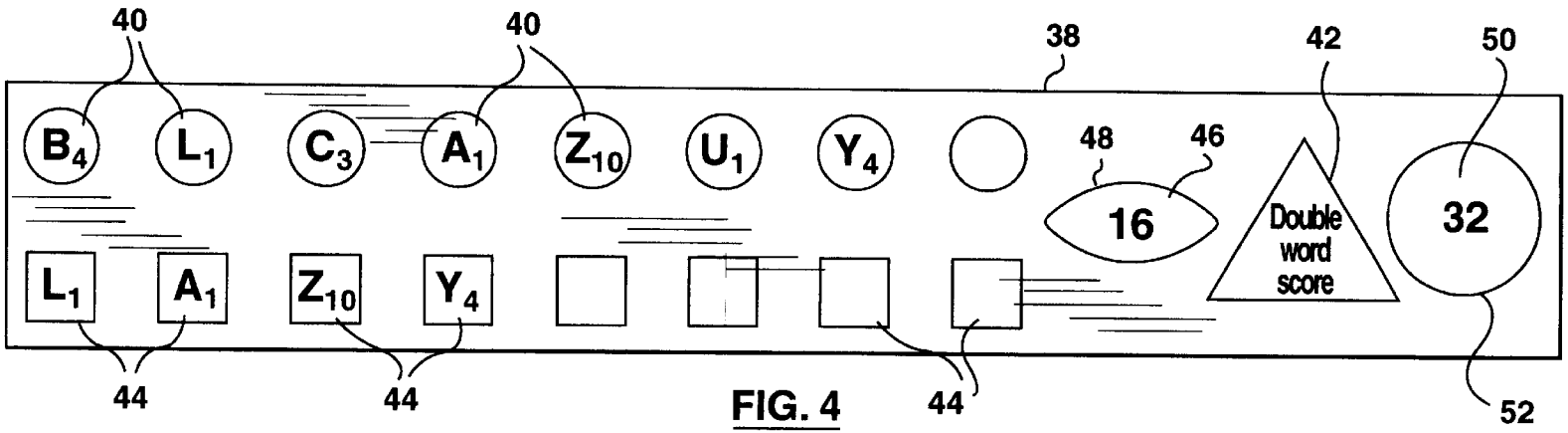
FIG. 4 is a top view of a score sheet of the game, completed in an exemplary manner after a player's turn.

Each player, on his turn, places the dice 22 in an open ended vessel 36 of the game and then throws the dice 22 onto a playing surface 37 using the vessel 36. The dice 22 will thereby land on the playing surface 37 with a side of each dice 22 marked with a corresponding letter indicia 24 facing up. Referring to FIG. 4, the letter indicia facing up are then written down on a score sheet 38 in circular spaces 40 provided for this purpose. Next, the player randomly selects a score manipulation member 26 from the oval track 28 and turns it over to reveal scoring indicia 32. In this example, the scoring indicia selected is a "double word score" 32*a* which is then written in a triangular space 42 provided on the score sheet 38. The player must then form a word using the letter indicia 24 selected. In this case, the word formed is "lazy" as shown in FIGS. 2 and 4. "Lazy" is then written in square spaces 44 of the score sheet 38 and the point values of each letter indicia 24 in the word are added to arrive at an initial score value "16" designated by numeral 46 which is then written in an ogive-shaped space 48 of the score sheet 38. Using the selected scoring indicia 32*a*, the initial score value 46 is manipulated to arrive at a final score value of "32" designated by numeral 50 which is then marked in a circular space 52 provided on the score sheet 38. Thus, on this turn, the player has achieved a score of 32 to which additional points may be added on his next turn.

The play then goes to the next player who employs the same method as described above in determining a final score value on that next player's turn and so forth. The number of score manipulation members 26 from which a selection may be made on a player's turn is reduced by 1 at each turn since, once a score manipulation member 26 is selected, it is no longer available for selection on subsequent turns. The game ends when all the score manipulation members are used. The player with the highest score wins. In the case of a tie, the tied players may play another round to determine a winner, if desired.

On any player's turn, any number of the other players may challenge the word formed by the subject player if they believe the word does not exist, as determined with reference to a dictionary agreed to in advance by the players. All challengers are required to stake points up to a maximum of ten points. The points staked by any challenger need not be the same as the amount staked by another challenger. If a challenger is correct, his total point value is increased by the amount he staked and the subject player's total point value is decreased by the same amount. Conversely, if the challenger is incorrect, his total point value is decreased by the amount he staked and the subject player's total point value is increased by the same amount. Where there is more than one challenger, the subject player's total points increase or decrease by the total points waged by all the challengers.

In the event of a challenge, a subject player is given the option of passing on his turn, to obtain a score of "0" on that turn, in order to avoid a possible reduction in the value of his existing score. Also, any number of the other non-challenging players who believe that the word does in fact exist, may stake points to that effect. In such event, the respective total point value of each player who believes the word exists increases or decreases by the amount staked if the word exists or does not exist, respectively. The subject player's score is not affected by the participation of those other players who believe that the word exists.

No player can stake points or challenge the existence or non-existence of a word he himself plays.

Should a player be able to form a word using seven of the letter indicia 24, a thirty point bonus is awarded which is added to the final score value of the word. In the event that all eight letter indicia 24 are used in forming a word, this feat is rewarded by granting that player an extra sixty points which, again, are added to the final score value.

The vessel 36 is provided with holes 38,40 which facilitate gripping of the vessel 36. However, the use of the holes 38,40 is optional as clearly illustrated in FIG. 1 and, as such, they may be dispensed with.

FIG. 3 illustrates the types of scoring indicia employed by the game 20. Scoring indicia 32*b* results in no change to the original score value. Thus, in the case of the word "lazy" the final score value will be 16. Scoring indicia 32*c* causes the last letter of the word to be tripled. Thus, the final score value of the word "lazy" would be 24. Scoring indicia 32*d* triples the initial score value of the word to give rise to a final score value of 48 for "lazy". Scoring indicia 32*e* takes the second letter of the word and doubles its value to give a score of 17 in this example.

Finally, scoring indicia 32*f* doubles the value of the first and last letter of the word to give a score of 21.

In the word game 20, the letter indicator members are in the form of eight dice 22 and letters of the alphabet and blanks are randomly distributed on the sides of the dice 22. It will be appreciated that the number of letter indicator members and the number of sides of each letter indicator member may vary without departing from the scope of the invention.

It will furthermore be appreciated that the occurrence of each letter of the alphabet on the letter indicator members is highly variable without departing from the scope of the invention. Preferably, the occurrence will mimic the occurrence of such letters in words generally. For example, since the letter "x" is not a commonly occurring letter in the English language, such letter is preferably marked only once on the letter indicator members. Conversely, vowels are preferably marked more than once on the letter indicator members as they are commonly required in the formation of a word. Although the English language is used in the case of the preferred embodiment, it will be appreciated that the present invention may be adapted for play involving other languages wherein words may be formed from individual letters or the like.

It will also be appreciated that the use of a score sheet and a vessel for throwing letter indicator members onto a playing surface is optional as the dice can be picked up and thrown without using the vessel and score may be kept on any clean sheet of paper. Also optional is the game board 30 as the score manipulation members may be arranged randomly on a playing surface such as a table top. The score manipulation members may, alternatively, be placed in a bag and selected at random from the bag on each player's turn. In this alternative, the score manipulation members may be returned to the bag after selection and the end of the game may be determined by other means, such as a first player reaching a predetermined score, for example. The score manipulation members may also have different scoring indicia than those shown in FIG. 3 and should not be limited to those specifically described.

The method of selecting the letter indicia may also vary. For example, the letter indicia may be in the form of letters marked on tiles placed in a bag. In such case, each player, on his turn, may select a fixed number of tiles from the bag and attempt to form a word using the letter indicia selected. After the player's turn, the tiles may then be thrown back into the bag for selection by the next player on his turn.

A further alternative to the present method of playing the game 20 is to have each player form a word prior to selecting a score manipulation member, on each turn. This would introduce an element of randomness in the final score value of the word so formed which may be desirable when playing with young children or otherwise less sophisticated players, thereby giving such players a chance to win.

It will be appreciated that numerous variations to the game and method of the present invention may be made without departing from the scope of the invention as defined by the following claims.

I claim:

1. A word game comprising:

a plurality of letter indicator members, each having a letter indicia corresponding to a selected letter or choice of letter, each letter indicia being assigned a predetermined point value for use in calculating an initial score value of a word formed from a random selection of said letter indicia; and a plurality of separate and independently movable score manipulation members, each having a scoring indicia for manipulating the initial score value and determining a final score value of said word, said score manipulation members being arrangeable in a random and different order from one game to the next.

2. A word game according to claim 1 wherein each of said letter indicator members has a plurality of sides marked with a corresponding plurality of said letter indicia, respectively.

3. A word game according to claim 2 comprising at least five of said letter indicator members, each having at least six sides.

4. A word game according to claim 3 wherein the number of letter indicator members is eight and each letter indicator member is a die having six sides.

5. A word game according to claim 1 comprising a game board having a plurality of receptacles corresponding in number to the number of score manipulation members, said score manipulation members being arrangeable randomly in the receptacles with said scoring indicia hidden from view.

6. A word game according to claim 5 wherein said receptacles are arranged in an oval pattern in the game board.

7. A word game according to claim 1 further comprising an open-ended vessel for use in holding and throwing said letter indicator members onto a playing surface.

8. A method of playing a word game comprising the steps of:

(1) initially, (a) providing a plurality of letter indicator members, each having a letter indicia corresponding to a selected letter or choice or letter, each letter indicia being assigned a predetermined point value;

(b) providing a plurality of separate and independently movable score manipulation members, each having scoring indicia; and (c) arranging said score manipulation members randomly and in a different order than the order used in a previous game; and (2) on each player's turn, (a) randomly selecting a plurality of said letter indicia;

(b) randomly selecting one of said score manipulation members;

(c) forming a word from the letter indicia selected; and (d) calculating a final score value of the word so formed with reference to the predetermined point values of the letter indicia in the word and the scoring indicia of the score manipulation member selected.

9. A method of playing a word game according to claim 8 wherein the letter indicator members each have a plurality of sides marked with a corresponding plurality of said letter indicia, respectively.

10. A method of playing a word game according to claim 9 comprising;

(1) initially, (d) providing an open-ended vessel for holding said letter indicator members; and (2) on each player's turn, in step (2)(a), placing said letter indicator members in said vessel and throwing the letter indicator members onto a playing surface using said vessel, said letter indicator members thereby landing on the playing surface with a side of each letter indicator member marked with a corresponding letter indicia facing up; and in step (2)(c), forming a word using the letter indicia facing up.

11. A method of playing a word game according to claim 8 comprising:

(1) initially, providing a game board having a series of receptacles corresponding in number to the number of score manipulation members; and, in step (1)(c), arranging said score manipulation members in a random order in the receptacles with said scoring indicia hidden from view.

12. A method of playing a word game according to claim 8 comprising:

(2) on each player's turn, after step (2)(c), providing other players with the option of challenging the word formed by a subject player on his turn, increasing and decreasing the score of the challenger and subject player by a predetermined amount, respectively, if the challenger is correct in determining that the word does not exist, as determined with reference to a dictionary agreed to in advance by the players, and decreasing and increasing the score of the challenger and subject player by a predetermined amount, respectively, if the challenger is wrong.

13. A method of playing a word game according to claim 8 comprising, in step (2)(d), awarding bonus points if all, or all but one of, the letter indicia selected are used in forming the word.

* * * * *